US009746196B2

(12) United States Patent
Su et al.

(10) Patent No.: US 9,746,196 B2
(45) Date of Patent: Aug. 29, 2017

(54) AIR-GUIDING CASING OF A VENTILATION FAN

(71) Applicant: Sunonwealth Electric Machine Industry Co., Ltd., Kaohsiung (TW)

(72) Inventors: Chia-Hung Su, Kaohsiung (TW); Cheng-Wei Lin, Kaohsiung (TW); Ho-Min Huang, Kaohsiung (TW); Chi-Hung Kuo, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 359 days.

(21) Appl. No.: 14/525,305

(22) Filed: Oct. 28, 2014

(65) Prior Publication Data

US 2015/0184878 A1 Jul. 2, 2015

(30) Foreign Application Priority Data

Dec. 26, 2013 (TW) ..... 102148468 A

(51) Int. Cl.

| | |
|---|---|
| ***F24F 7/007*** | (2006.01) |
| ***F04D 25/14*** | (2006.01) |
| ***F04D 29/42*** | (2006.01) |
| ***F04D 29/62*** | (2006.01) |

(52) U.S. Cl.

CPC ..... *F24F 7/007* (2013.01); *F04D 25/14* (2013.01); *F04D 29/4226* (2013.01); *F04D 29/626* (2013.01)

(58) Field of Classification Search

CPC ..... F04D 25/14; F04D 29/4226; F04D 29/626
See application file for complete search history.

(56) References Cited

U.S. PATENT DOCUMENTS

| | | | | |
|---|---|---|---|---|
| 3,867,064 | A * | 2/1975 | Sorensen | F04D 29/483 406/96 |
| 4,867,640 | A * | 9/1989 | Penlesky | F04D 29/626 415/204 |
| 6,261,175 | B1 * | 7/2001 | Larson | F24F 7/007 415/204 |
| 6,979,169 | B2 * | 12/2005 | Penlesky | F04D 29/4226 415/1 |
| 7,175,309 | B2 * | 2/2007 | Craw | F21V 29/02 362/149 |
| 7,203,416 | B2 * | 4/2007 | Craw | F24H 3/0411 392/350 |

(Continued)

FOREIGN PATENT DOCUMENTS

| | | |
|---|---|---|
| CN | 1616896 A | 5/2005 |
| TW | M370725 U | 12/2009 |
| TW | M391590 U | 11/2010 |

*Primary Examiner* — Igor Kershteyn
(74) *Attorney, Agent, or Firm* — Alan D. Kamrath; Kamrath IP Lawfirm, P.A.

(57) ABSTRACT

An air-guiding casing of a ventilation fan includes a main body and an air-guiding tube. The main body forms a compartment and includes an inlet and an outlet. The inlet and the outlet are in communication with the compartment. A first engaging portion is arranged on a part of an edge of the outlet and on one side of the main body. The air-guiding tube has an engaging end and an outlet end opposite to the engaging end. A second engaging portion is arranged on the engaging end. The first and second engaging portions are engaged with each other.

5 Claims, 5 Drawing Sheets

(56) References Cited

U.S. PATENT DOCUMENTS

| | | | | |
|---|---|---|---|---|
| 8,961,126 | B1 * | 2/2015 | Tom | F24F 13/078 362/368 |
| 9,028,212 | B1 * | 5/2015 | Tom | F04D 1/04 416/5 |
| 9,097,265 | B1 * | 8/2015 | Tom | F04D 29/626 |
| 9,303,859 | B2 * | 4/2016 | Horng | F24F 13/078 |
| 9,344,787 | B2 * | 5/2016 | Berkman | H04R 1/028 |
| 2008/0261508 | A1 * | 10/2008 | Deng | F24F 7/06 454/354 |
| 2008/0299891 | A1 * | 12/2008 | Deng | F21V 19/04 454/354 |
| 2009/0170421 | A1 * | 7/2009 | Adrian | F24F 7/06 454/349 |
| 2010/0284803 | A1 * | 11/2010 | Yang | F04D 25/12 415/204 |
| 2012/0164936 | A1 * | 6/2012 | Gao | F24F 7/007 454/341 |
| 2015/0354595 | A1 * | 12/2015 | Su | F04D 29/4226 415/201 |

* cited by examiner

AIR-GUIDING CASING OF A VENTILATION FAN

BACKGROUND OF THE INVENTION

1. Field of the Invention

The present invention generally relates to an air-guiding casing of a ventilation fan and, more particularly, to an air-guiding casing of a ventilation fan having a detachable air-guiding tube.

2. Description of the Related Art

FIG. 1 shows a conventional air-guiding casing 9 including a main body 91 and an air-guiding tube 92 affixed to the outer periphery of main body 91. Main body 91 includes a compartment 911 and an air inlet 912 in communication with compartment 911. Air-guiding tube 92 includes an air outlet 921 in communication with compartment 911. In this arrangement, an impeller can be received in compartment 911 of main body 91. An alternating current (AC) or direct current (DC) motor is used to power the impeller so that the impeller can be operated to draw air into compartment 911 via air inlet 912 and to discharge air from compartment 911 via air outlet 921. As such, a desired ventilation effect can be provided. Taiwan Patent No. M391590 discloses a similar air-guiding casing.

However, air-guiding casing 9 has a drawback that main body 91 and air-guiding tube 92 cannot be easily detached from each other. In this regard, when it is desired to replace the impeller (or the air-guiding tube 92) with another one having a different size, the entire air-guiding casing 9 must be changed. In other words, it is impossible to change only the main body 91 or the air-guiding tube 92. This results in an inconvenience in use and increases the cost. Therefore, it is necessary to improve the conventional air-guiding casing 9.

SUMMARY OF THE INVENTION

It is therefore the objective of this invention to provide an air-guiding casing of a ventilation fan having a detachable main body and air-guiding tube, thereby overcoming the deficiency of the conventional air-guiding casing having an undetachable main body and air-guiding tube.

In an embodiment of the invention, an air-guiding casing of a ventilation fan comprises a main body and an air-guiding tube. The main body forms a compartment and comprises an inlet and an outlet. The inlet and the outlet are in communication with the compartment. A first engaging portion is arranged on a part of an edge of the outlet and on one side of the main body. The air-guiding tube has an engaging end and an outlet end opposite to the engaging end. A second engaging portion is arranged on the engaging end. The first and second engaging portions are engaged with each other.

In a form shown, the main body further comprises a base plate and a plurality of side plates arranged at an outer periphery of the base plate. The base plate and the plurality of side plates together define the compartment. The outlet is arranged on one of the plurality of side plates.

In the form shown, two opposing wings are arranged on the one of the plurality of side plates. The two opposing wings are located at part of the edge of the outlet. Each of the two opposing wings comprises at least one engaging hole. Two opposing guiding plates are arranged at the engaging end of the air-guiding tube. Each of the two opposing guiding plates comprises at least one hook engaged with the at least one engaging hole.

In the form shown, the two opposing wings are spaced from each other at a first distance, and the two opposing guiding plates are spaced from each other at a second distance. The second distance is slightly larger than the first distance.

In the form shown, the two opposing wings are spaced from each other at a first distance, and the two opposing guiding plates are spaced from each other at a second distance. The second distance is equal to the first distance.

In the form shown, two opposing positioning plates are arranged on another part of the edge of the outlet. The two opposing positioning plates are located between the two opposing wings to position the air-guiding tube.

In the form shown, a rotatable dustproof plate is arranged in the air-guiding tube.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
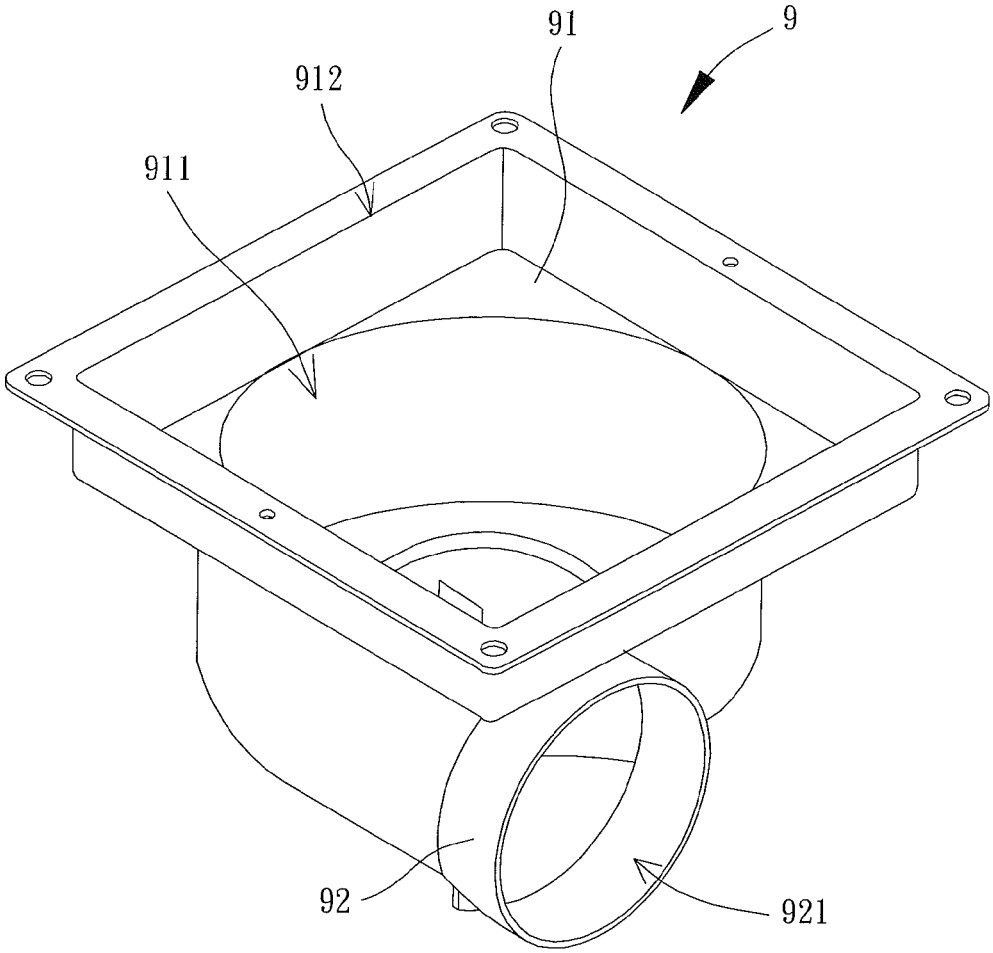
FIG. 1 PRIOR ART
FIG. 1 shows a conventional air-guiding casing of a ventilation fan.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
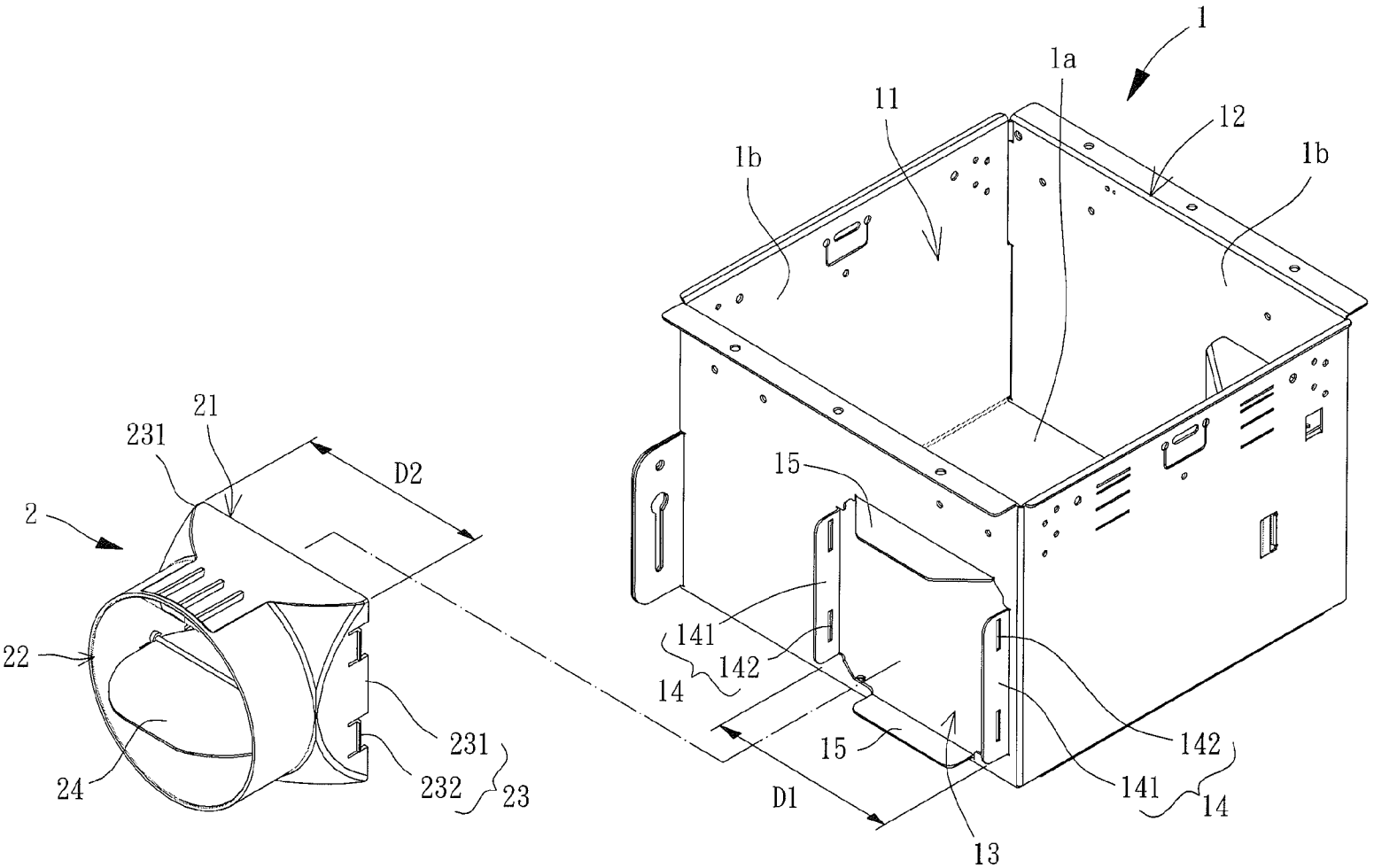
FIG. 2 is an exploded view of an air-guiding casing of a ventilation fan according to an embodiment of the invention.

Referring to FIG. 2, an air-guiding casing of a ventilation fan according to an embodiment of the invention comprises a main body 1 and an air-guiding tube 2. Main body 1 and air-guiding tube 2 can be attached to or detached from each other.

Main body 1 forms a compartment 11 that can be of any geometric structure capable of receiving an impeller, as it can be readily appreciated by one skilled in the art. Main body 1 includes an inlet 12 and an outlet 13 in which both the inlet 12 and the outlet 13 are in communication with compartment 11. A first engaging portion 14 is arranged on a part of an edge of outlet 13 and on one side of main body 1. Air-guiding tube 2 can be engaged with main body 1 (as will be discussed in detail later).

As the example shown in FIG. 2, main body 1 may further include a base plate 1*a* and a plurality of side plates 1*b* arranged at an outer periphery of base plate 1*a*. The base plate 1*a* and the plurality of side plates 1*b* together define compartment 11. The base plate 1*a* and the plurality of side plates 1*b* together may be in various geometric forms, such as a cubic form, a polygonal form or a cylindrical form, but is not limited to the above. Outlet 13 may be arranged on any of the plurality of side plates 1*b*. In the embodiment, two opposing wings 141 may be arranged on the side plate 1*b* having outlet 13, with the two opposing wings 141 located at the edge of outlet 13. The two opposing wings 141 are spaced from each other at the left and right sides according to the arrangement in the drawing. Each wing 141 includes at least one engaging hole 142 in order to form first engaging portion 14. Furthermore, two opposing positioning plates 15 may also be arranged on another part of the edge of outlet 13. The two opposing positioning plates 15 are spaced from each other at the upper and lower sides according to the arrangement in the drawing. In this regard, the two opposing positioning plates 15 are located between the two wings 141. However, the two wings 141 and the two opposing positioning plates 15 can be swapped, as it can be readily appreciated by one skilled in the art. In addition, the two opposing positioning plates 15 may be spaced from each other at a distance slightly larger than or equal to a maximum diameter of air-guiding tube 2. As such, when air-guiding tube 2 is affixed to outlet 13, the two opposing positioning plates 15 are able to guide the positioning of air-guiding tube 2. In this manner, air-guiding tube 2 can be smoothly affixed to main body 1 and positioned by the two opposing positioning plates 15.

Figure 4:
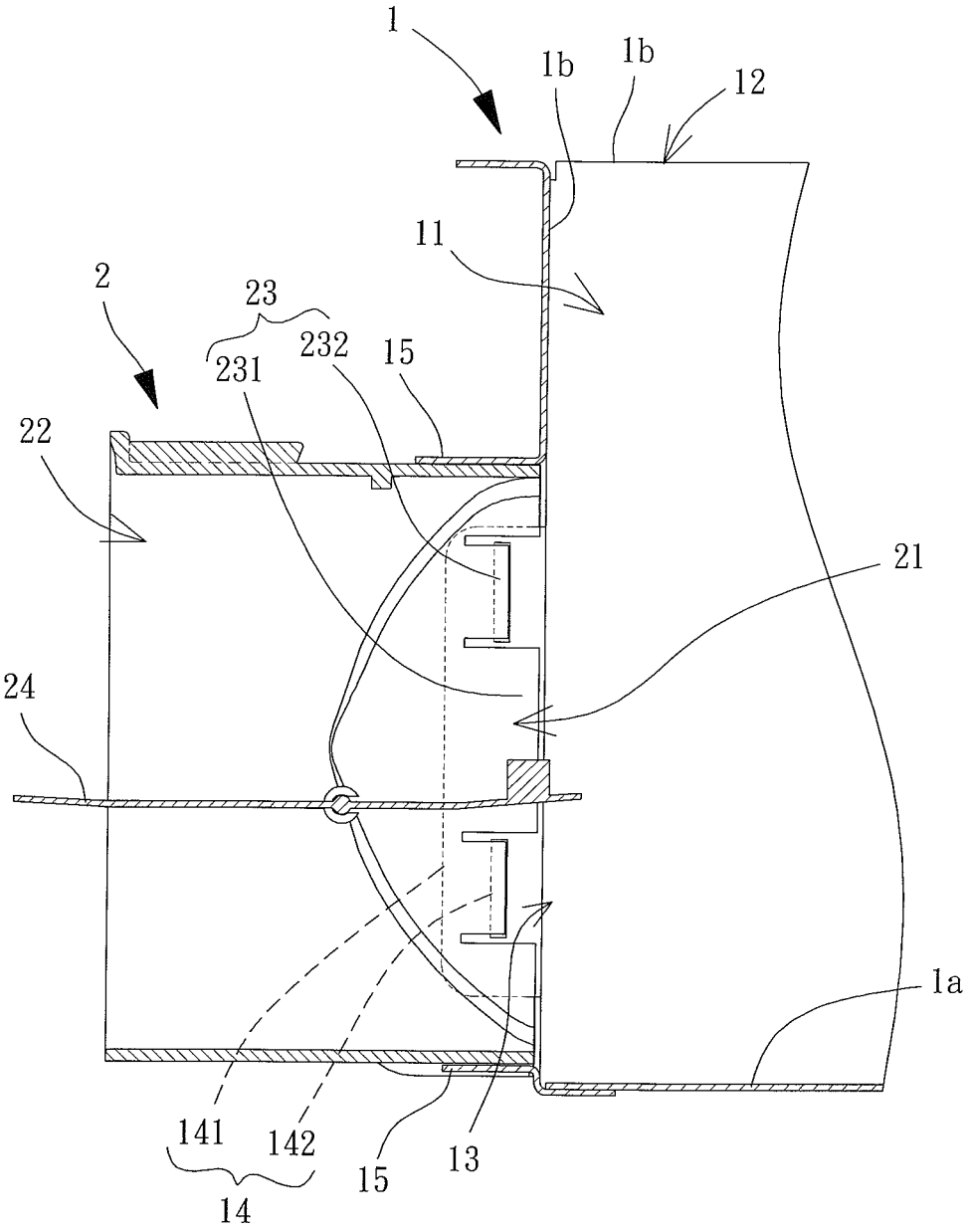
FIG. 4 is a cross-sectional view of the air-guiding casing of the ventilation fan of the embodiment of the invention after assembly, taken in the longitudinal direction of the air-guiding casing.

Air-guiding tube 2 may be in the form of a hollow tube having two openings at two ends thereof. Air-guiding tube 2 is not limited to any shape. Specifically, air-guiding tube 2 includes an engaging end 21 and an outlet end 22. A second engaging portion 23 is arranged on the engaging end 21. Second engaging portion 23 may be in any form capable of engaging with first engaging portion 14. Outlet end 22 is used to guide the air out of air-guiding tube 2. In the embodiment, two opposing guiding plates 231 are arranged at engaging end 21 of air-guiding tube 2. The two opposing guiding plates 231 are spaced from each other at the left and right sides according to the arrangement in the drawing. Each guiding plate 231 includes at least one hook 232 in order to form second engaging portion 23. The at least one hook 232 and the at least one engaging hole 142 can also be swapped, as it can be readily appreciated by one skilled in the art. Moreover, a rotatable dustproof plate 24 may be arranged in air-guiding tube 2. Dustproof plate 24 lies vertically when there is no airflow passing through air-guiding tube 2, thereby closing the air-guiding tube 2 for dustproof purposes. When there is airflow passing through air-guiding tube 2, dustproof plate 24 is driven to rotate. In this regard, air-guiding tube 2 is opened to allow the air to pass therethrough, as shown in FIGS. 2 and 4.

Figure 3:
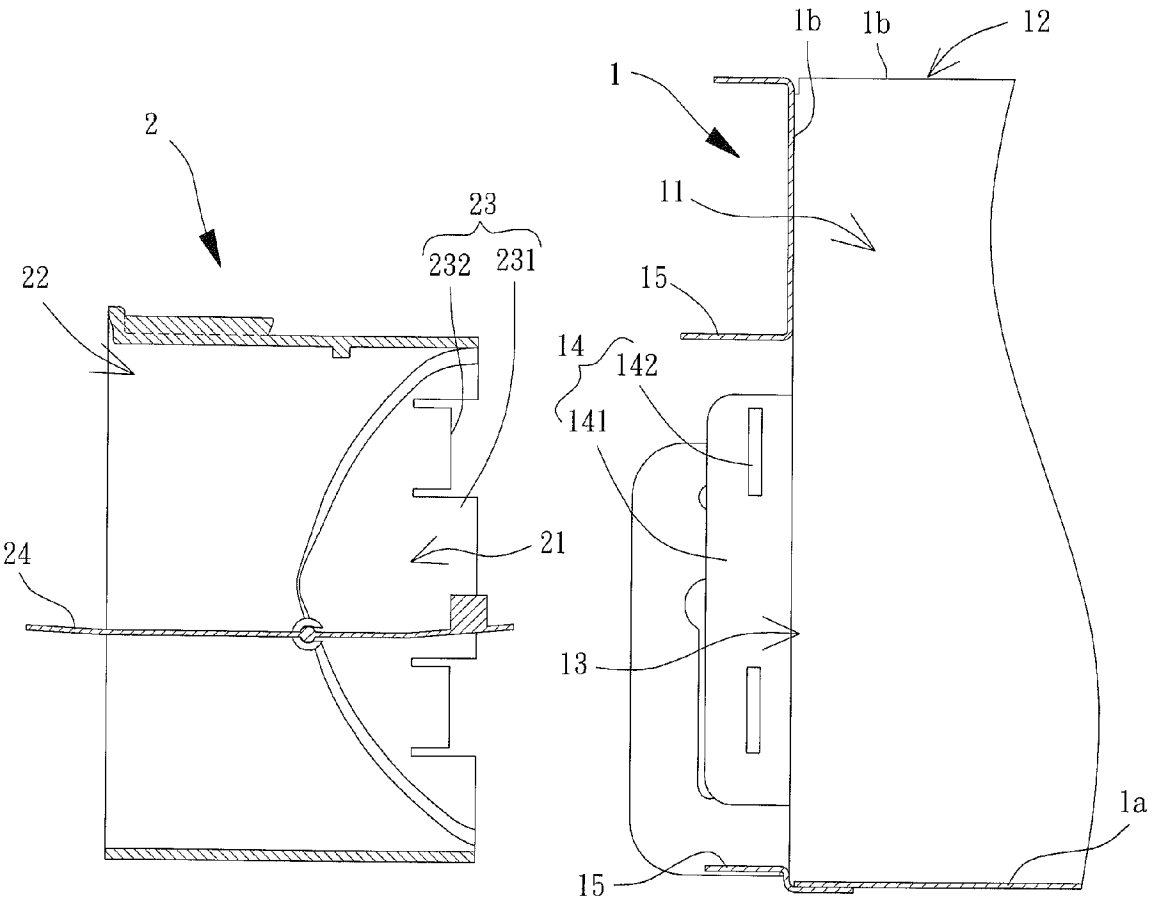
FIG. 3 is a cross-sectional view of the air-guiding casing of the ventilation fan of the embodiment of the invention before assembly, taken in a longitudinal direction of the air-guiding casing.
Figure 5:
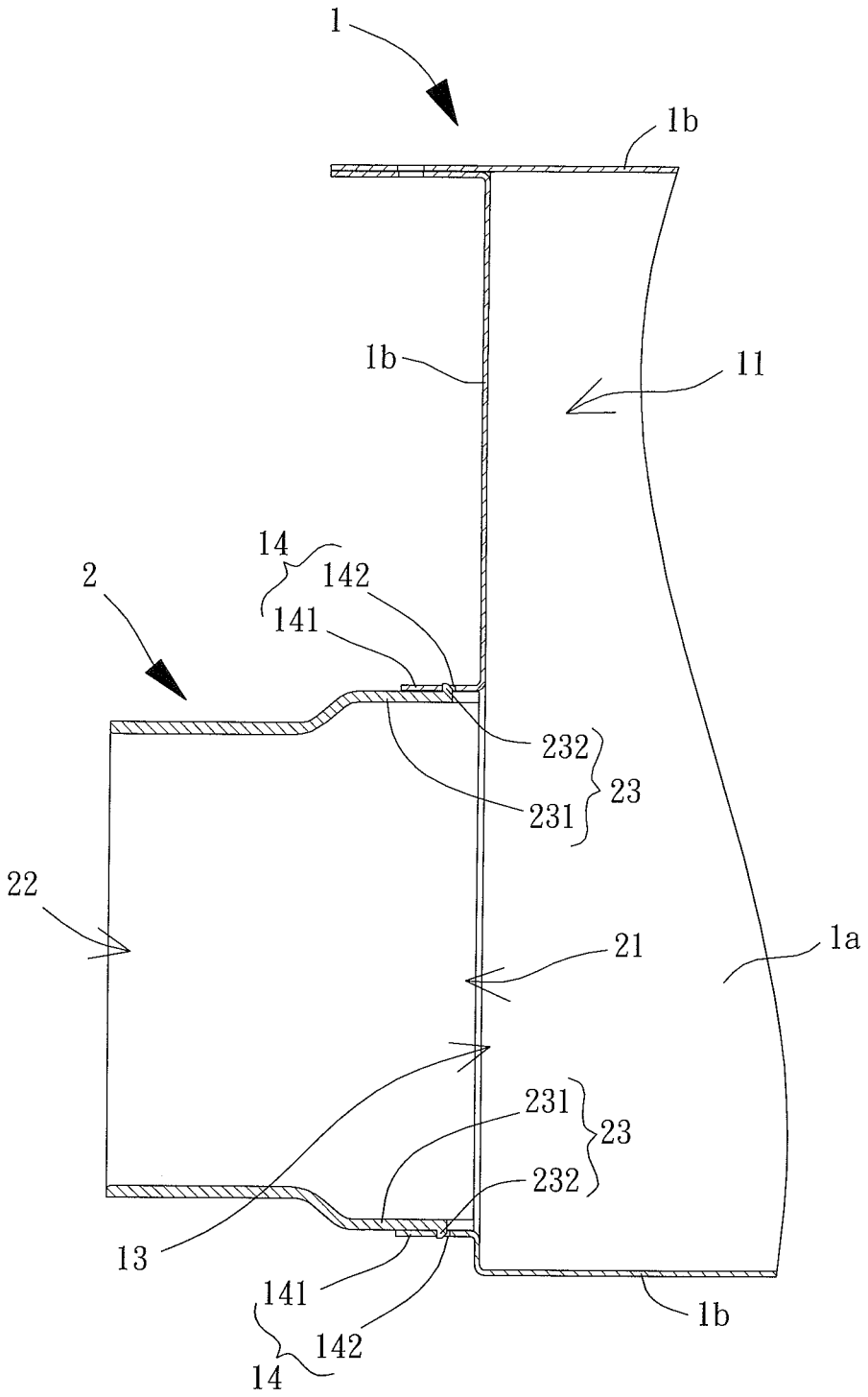
FIG. 5 is a cross-sectional view of the air-guiding casing of the ventilation fan of the embodiment of the invention after assembly, taken in a transverse direction of the air-guiding casing perpendicular to the longitudinal direction.

Please refer to FIGS. 2 and 3, during the assembly of air-guiding tube 2, engaging end 21 should face outlet 13 of main body 1. In this regard, the two opposing positioning plates 15 may be used to position air-guiding tube 2, as shown in FIGS. 4 and 5. Thus, the two opposing guiding plates 231 may be positioned between the two wings 141 of main body 1 while second engaging portion 23 is engaged with first engaging portion 14 of main body 1. At the same time, air-guiding tube 2 can be clamped between the two opposing positioning plates 15 of main body 1, thereby securing the positioning of air-guiding tube 2. In addition, as shown in FIG. 2, there is a first distance D1 between the two wings 141 of main body 1, and there is a second distance D2 between the two opposing guiding plates 231 of air-guiding tube 2. Second distance D2 is slightly larger than or equal to first distance D1. The two opposing guiding plates 231 of air-guiding tube 2 can be forcibly engaged between the two wings 141 of main body 1, and the at least one hook 232 can be engaged into the at least one engaging hole 142. In this manner, the two wings 141 of main body 1 also provides a positioning function for air-guiding tube 2, improving the coupling effect between main body 1 and air-guiding tube 2. In this arrangement, compartment 11 of main body 1 can be used to receive an impeller that, when driven by an AC or DC motor, draws air via inlet 12 and discharges air via outlet end 22 of air-guiding tube 2. As such, a desired ventilation effect can be achieved.

Based on the structural design of the air-guiding casing of the ventilation fan according to the embodiment of the invention, first engaging portion 14 of main body 1 and second engaging portion 23 of air-guiding tube 2 can be easily engaged with or disengaged from each other. As a result, when the impeller or the air-guiding tube 2 is to be replaced by another one with a different size, air-guiding tube 2 may be detached from main body 1. Thus, convenient replacement of the impeller or the air-guiding tube 2 is achieved. During the replacement, it is simply required to confirm that first engaging portion 14 of main body 1 and second engaging portion 23 of air-guiding tube 2 can be engaged with each other. Advantageously, the entire air-guiding casing needn't be changed when changing only the impeller or the air-guiding tube 2, achieving convenient use and reducing the cost.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An air-guiding casing of a ventilation fan, comprising:

a main body including a base plate and a plurality of side plates arranged at an outer periphery of the base plate, with the base plate and the plurality of side plates together defining a compartment, with the main body further including an inlet in communication with the compartment, with the main body further including an outlet in one of the plurality of side plates, with the outlet being in communication with the compartment, with two opposing wings respectively disposed on two opposite edges of the outlet, with each of the two opposing wings including at least one engaging hole, wherein the two opposing wings are spaced from each other by a first distance in a first direction; and an air-guiding tube including an engaging end and an outlet end opposite to the engaging end, with two opposing guiding plates disposed on the engaging end of the air-guiding tube, with each of the two opposing guiding plates including at least one hook removably engaged with the at least one engaging hole of one of the two opposing wings, wherein the two opposing guiding plates are spaced from each other by a second distance in the first direction, wherein the second distance is slightly larger than the first distance, wherein the two opposing guiding plates of the air-guiding tube are forcibly engaged between the two opposing wings of the main body, and wherein the two opposing wings of the main body securely clamp the air-guiding tube.

2. The air-guiding casing of the ventilation fan as claimed in claim 1, wherein two opposing positioning plates are arranged on another two opposite edges of the outlet, and wherein the two opposing positioning plates are located between the two opposing wings to position the air-guiding tube.

3. The air-guiding casing of the ventilation fan as claimed in claim 1, wherein a rotatable dustproof plate is arranged in the air-guiding tube.

4. The air-guiding casing of the ventilation fan as claimed in claim 1, with the at least one engaging hole of each of the two opposing wings including two engaging holes spaced from each other and arranged in a second direction perpendicular to the first direction, with the at least one hook of each of the two opposing guiding plates including two hooks, with each of the two opposing guiding plates including two pairs of slots spaced from each other in the second direction, with each of the two pairs of the slots defining a resilient section therebetween, with one of the two hooks formed on an outer surface of each resilient section and extending outwardly of a corresponding one of the two opposing guiding plates, with the two hooks of each of the two opposing guiding plates arranged in the second direction, with the two hooks of each of the two opposing guiding plates of the air-guiding tube respectively and removably engaged with the two engaging holes of one of the two opposing wings of the main body, and with each of the two opposing guiding plates of the air-guiding tube having an outer surface abutting against an inner surface of one of the two opposing wings of the main body.

5. The air-guiding casing of the ventilation fan as claimed in claim 1, wherein the at least one hooks of the two opposing guiding plates extend away from each other.

* * * * *